US009200472B2

(12) United States Patent
Lee

(10) Patent No.: US 9,200,472 B2
(45) Date of Patent: Dec. 1, 2015

(54) PUSH-PULL DOOR LOCK CAPABLE OF SELECTING LEVER WORK DIRECTION

(71) Applicant: SAMSUNG SNS CO., LTD., Seoul (KR)

(72) Inventor: Sang-Han Lee, Gunpo-si (KR)

(73) Assignee: SAMSUNG SDS CO., LTD. (KR)

( * ) Notice: Subject to any disclaimer, the term of this patent is extended or adjusted under 35 U.S.C. 154(b) by 79 days.

(21) Appl. No.: 13/871,240

(22) Filed: Apr. 26, 2013

(65) Prior Publication Data

US 2014/0260458 A1 Sep. 18, 2014

(30) Foreign Application Priority Data

Mar. 13, 2013 (KR) ..... 20-2013-0001889

(51) Int. Cl.

| | |
|---|---|
| ***E05B 65/10*** | (2006.01) |
| ***E05B 3/10*** | (2006.01) |
| ***E05B 7/00*** | (2006.01) |
| ***E05B 63/04*** | (2006.01) |
| ***E05B 63/16*** | (2006.01) |
| ***E05B 63/22*** | (2006.01) |

(52) U.S. Cl.

CPC . *E05B 7/00* (2013.01); *E05B 63/04* (2013.01); *E05B 63/16* (2013.01); *E05B 63/22* (2013.01); *Y10T 70/7441* (2015.04); *Y10T 70/7486* (2015.04); *Y10T 292/57* (2015.04)

(58) Field of Classification Search

CPC ..... E05B 1/00; E05B 1/007; E05B 1/0053; E05B 7/00; E05B 2001/06; E05B 2001/0076

USPC ..... 70/91, 92, 101, 107, 141, 142, 207, 70/224; 292/336.3

See application file for complete search history.

(56) References Cited

U.S. PATENT DOCUMENTS

| | | | | |
|---|---|---|---|---|
| 3,869,159 | A * | 3/1975 | Eads | 292/336.3 |
| 4,986,583 | A * | 1/1991 | Campbell et al. | 292/336.3 |
| 5,085,474 | A * | 2/1992 | Toledo et al. | 292/336.3 |
| 5,403,047 | A * | 4/1995 | Walls | 292/336.3 |
| 6,196,599 | B1 * | 3/2001 | D'Hooge | 292/336.3 |
| 6,293,598 | B1 * | 9/2001 | Rusiana | 70/91 |
| 6,322,113 | B1 * | 11/2001 | Ayers et al. | 292/336.3 |
| 6,357,807 | B1 * | 3/2002 | Fan | 292/336.3 |
| 7,258,374 | B2 * | 8/2007 | Rusiana | 292/336.3 |
| 8,419,081 | B2 * | 4/2013 | Zhang | 292/336.3 |
| 8,424,928 | B2 * | 4/2013 | Lin | 70/92 |
| 2010/0018268 | A1 * | 1/2010 | Parker | 70/489 |
| 2014/0246872 | A1 * | 9/2014 | Shen, Jimmy | 292/336.3 |

FOREIGN PATENT DOCUMENTS

KR 1020110096741 8/2011

* cited by examiner

*Primary Examiner* — Christopher Boswell

(74) *Attorney, Agent, or Firm* — Cantor Colburn LLP

(57) ABSTRACT

Provided is a push-pull door lock capable of selecting a lever work direction which may be installed without needing to coincide a door opening direction with the lever work direction by driving a driving unit during both a push operation and a pull operation of a lever coupled to each of housings of a front surface and a rear surface of a door to unlock a lock mechanism received in the door. The push-pull door lock includes: a lever that is provided on a front surface of each of housings, which are respectively coupled to an inside and an outside of a door by supports, to pivot in a front-and-back direction and has a protruding portion protruding toward a door; and a selection member that is provided on a rear surface of the housing and limits a pivoting range of the protruding portion in order to select a push operation or a pull operation of the lever.

7 Claims, 17 Drawing Sheets

PUSH-PULL DOOR LOCK CAPABLE OF SELECTING LEVER WORK DIRECTION

CROSS-REFERENCE TO RELATED APPLICATION

This application claims priority under 35 U.S.C. §119 to Korean Utility Model Application No. 20-2013-0001889 filed on Mar. 13, 2013, the disclosure of which is hereby incorporated by reference in its entirety.

BACKGROUND

1. Field

Embodiments of the inventive concept relate to a push-pull door lock, and more particularly, to a push-pull door lock capable of selecting a lever work direction which may provide a lever on a door without needing to coincide a door opening direction with the lever work direction by enabling a driving unit to unlock a lock mechanism received in the door during both a push operation and a pull operation of the lever coupled to housings of a front surface and a rear surface of the door.

2. Description of Related Art

A lock mechanism is provided in a door so that the door is in an open state or a closed state according to whether the lock mechanism is locked.

The lock mechanism is locked or unlocked by a first main body and a second main body provided on a front surface and a rear surface of the door.

The first main body and the second main body which lock or unlock the lock mechanism provided in the door include supports provided on the front surface and the rear surface of the door respectively and housings coupled to the supports.

In this case, a lever and a thumb-turn that unlock the lock mechanism are provided on the housing of the first main body or the second main body located in an interior.

A lever and a key input unit that unlock the lock mechanism are provided on the housing of the second main body or the first main body located in an exterior.

Accordingly, the door may be opened by unlocking the lock mechanism by using the lever and the thumb-turn of the housing of the first main body or the second main body located in the interior, and the door may also be opened by unlocking the lock mechanism by using the lever and the key input unit of the housing of the second main body or the first main body located in the exterior.

Meanwhile, a push-pull door lock which locks or unlocks a lock mechanism when levers of a first main body and a second main body perform a push or pull operation has been disclosed in KR 10-2011-96741 (published on Aug. 31, 2011).

In this case, the push-pull door lock unlocks the lock mechanism when the levers of the first main body and the second main body perform a push operation or a pull operation within a predetermined range of angles to rotate an actuating rod connected to the lock mechanism.

Since the push-pull door lock may open the door by just pulling or pushing the lever of the first main body or the second main body in a direction in which the door is opened, it is easier to use than a general door lock that opens a door by rotating a lever and then pulling or pushing the door.

However, in a conventional push-pull door lock A' as shown in FIG. 1, since a lever 30' on a main body may perform only one operation of a push operation and a pull operation and a lever 30' on another main body may perform only the other operation of the pull operation and the push operation and thus the main body on which the lever 30' for performing the push operation is provided has to be provided in a direction in which a door 200 is opened by being pushed and the main body on which the lever 30' for performing the pull operation is provided has to be provided in a direction in which the door 200 is opened by being pulled, a direction in which a door opening direction and a lever work direction have to coincide with each other inconveniently before the main bodies are provided.

If the door opening direction and the lever work direction do not coincide with each other, the lock mechanism may be unlocked when any lever operates and the door may be opened. However, since the door opening direction and the lever work direction do not coincide with each other, the door is in an awkward position, thereby making it difficult to open the door.

Accordingly, there have been attempts to develop a push-pull door lock that may be provided without needing to coincide a door opening direction with a lever work direction and may conveniently open a door after being provided, but with no satisfactory results yet.

SUMMARY

Embodiments of the inventive concept provide a push-pull door lock capable of selecting a lever work direction which may solve an inconvenient process of coinciding a door opening direction with the lever work direction which needs to be performed when a lever of a main body performs only one operation of a push operation and a pull operation, and may not cause a difficulty in opening a door which occurs when the door opening direction and the lever work direction do not coincide with each other and thus the door is in an awkward position.

The technical objectives of the inventive concept are not limited to the above disclosure; other objectives may become apparent to those of ordinary skill in the art based on the following descriptions.

In accordance with an aspect of the inventive concept, a push-pull door lock capable of selecting a lever work direction, the push-pull door lock includes: a lever that is provided on a front surface of each of housings, which are respectively coupled to an inside and an outside of a door by supports, to pivot in a front-and-back direction and has a protruding portion protruding toward a door; and a selection member that is provided on a rear surface of the housing and limits a pivoting range of the protruding portion in order to select a push operation or a pull operation of the lever.

The limiting of the pivoting range of the protruding portion may be performed when a position of a selection hole that is formed in the selection member and into and by which the protruding portion is inserted and caught is changed.

The selection hole may include one selection hole or first and second selection holes having different heights.

When the selection hole includes one selection hole, the one selection hole may be formed such that a position at which the protruding portion is caught varies as a position of the selection member is changed.

As the selection member horizontally moves on a support plate for supporting a driving unit that is moved by the protruding portion that pivots along with the lever, the protruding portion of the lever may be inserted into and caught by the first selection hole or the second selection hole.

A key input unit may be provided on the housing that is located in an exterior.

The key input unit may include any one or more of a keypad, a keyhole, and a card reader.

BRIEF DESCRIPTION OF THE DRAWINGS

The foregoing and other features and advantages of the inventive concepts will be apparent from the more particular description of preferred embodiments of the inventive concepts, as illustrated in the accompanying drawings in which like reference characters refer to the same parts throughout the different views. The drawings are not necessarily to scale, emphasis instead being placed upon illustrating the principles of the inventive concepts. In the drawings.

DETAILED DESCRIPTION OF THE EMBODIMENTS

Figure 1:
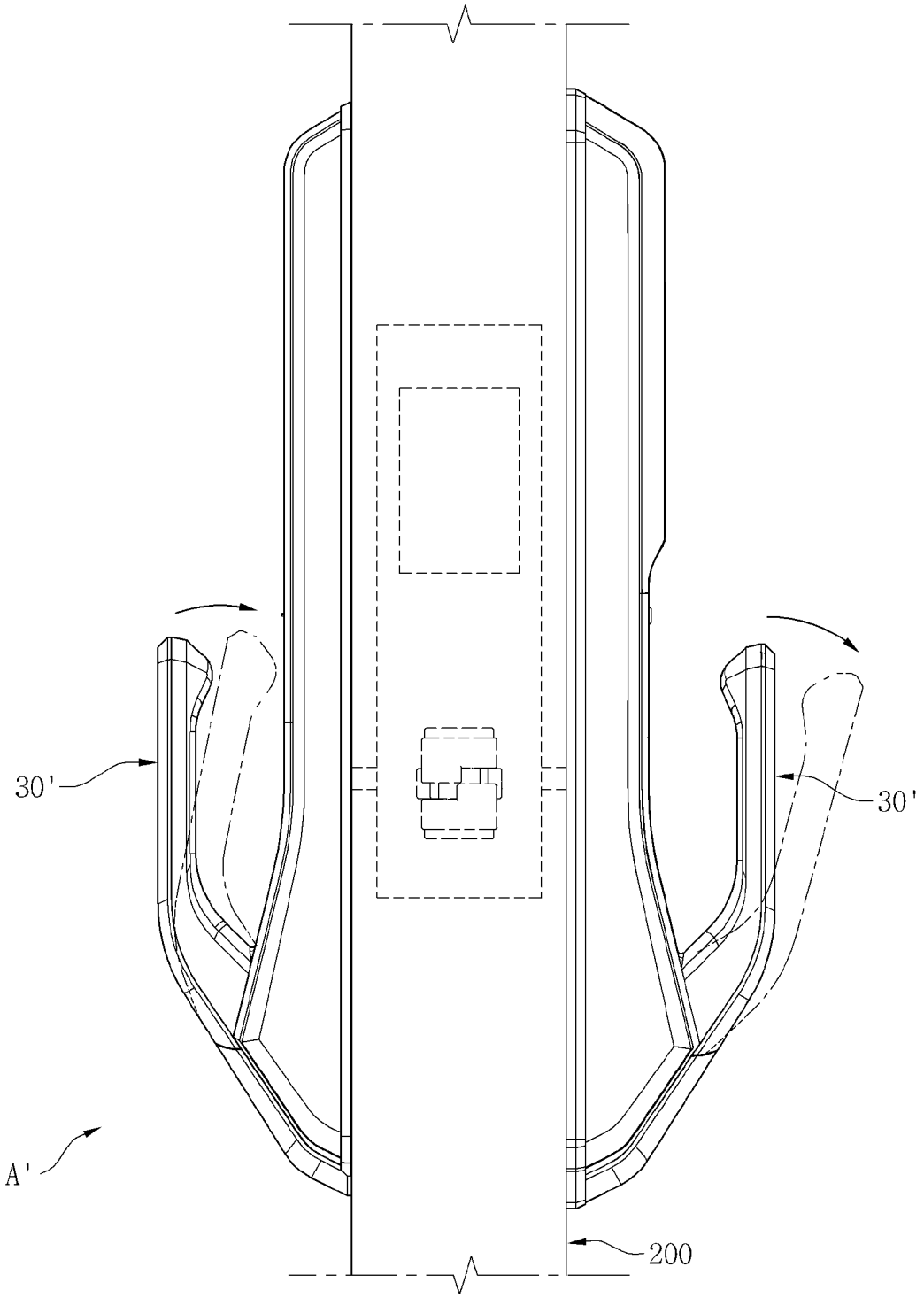
FIG. 1 PRIOR ART
FIG. 1 is a cross-sectional view illustrating an operation of a lever in a conventional push-pull door lock.

Various embodiments will now be described more fully with reference to the accompanying drawings in which some embodiments are shown. These inventive concepts may, however, be embodied in different forms and should not be construed as limited to the embodiments set forth herein. Rather, these embodiments are provided so that this disclosure is thorough and complete and fully conveys the inventive concept to those skilled in the art. In the drawings, the sizes and relative sizes of layers and regions may be exaggerated for clarity.

It will be understood that when an element or layer is referred to as being "on," "connected to," or "coupled to" another element or layer, it can be directly on, connected, or coupled to the other element or layer or intervening elements or layers may be present. In contrast, when an element is referred to as being "directly on," "directly connected to," or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present inventive concept.

Spatially relative terms, such as "beneath," "below," "lower," "above," "upper," and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, components, and/or groups thereof, but do not preclude the presence or addition of one or more other features, integers, steps, operations, elements, components, and/or groups thereof Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
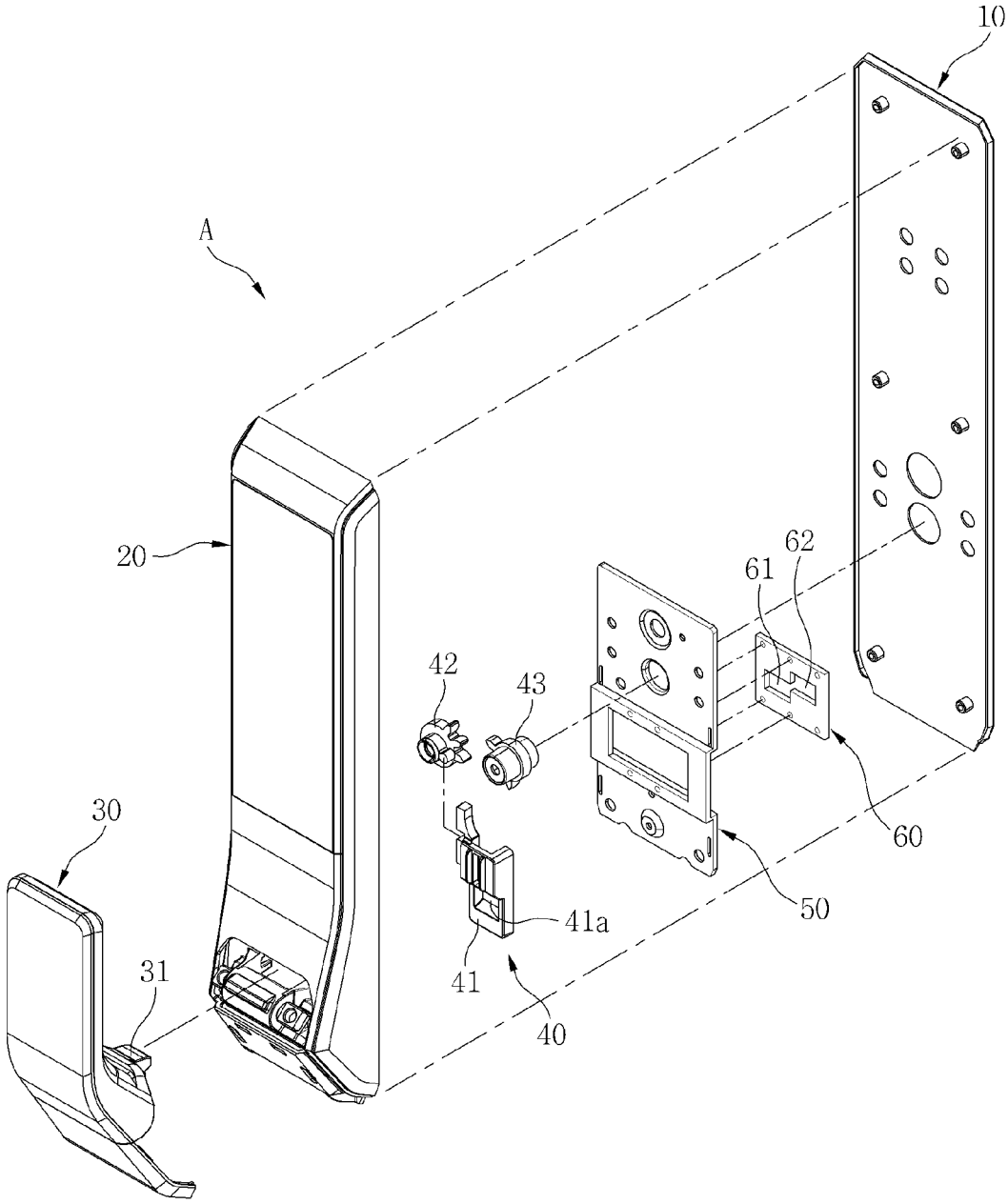
FIG. 2 is an exploded perspective view illustrating a push-pull door lock capable of selecting a lever work direction, according to an embodiment of the inventive concept.

FIG. 2 is an exploded perspective view illustrating a push-pull door lock A capable of selecting a lever work direction, according to an embodiment of the inventive concept. Referring to FIG. 2, the push-pull door lock A includes supports 10, housings 20, levers 30, and selection members 60.

The supports 10 are coupled to a front side and a rear side of a lock mechanism 100 received in a door 200.

The supports 10 are commonly used in a door lock, and thus a detailed explanation thereof will not be given.

The door 200 and the lock mechanism 100 to which the support 10 is coupled may have any of common structures and methods, and thus a detailed explanation thereof will not be given.

The housings 20 are respectively coupled to the supports 10.

Figure 8:
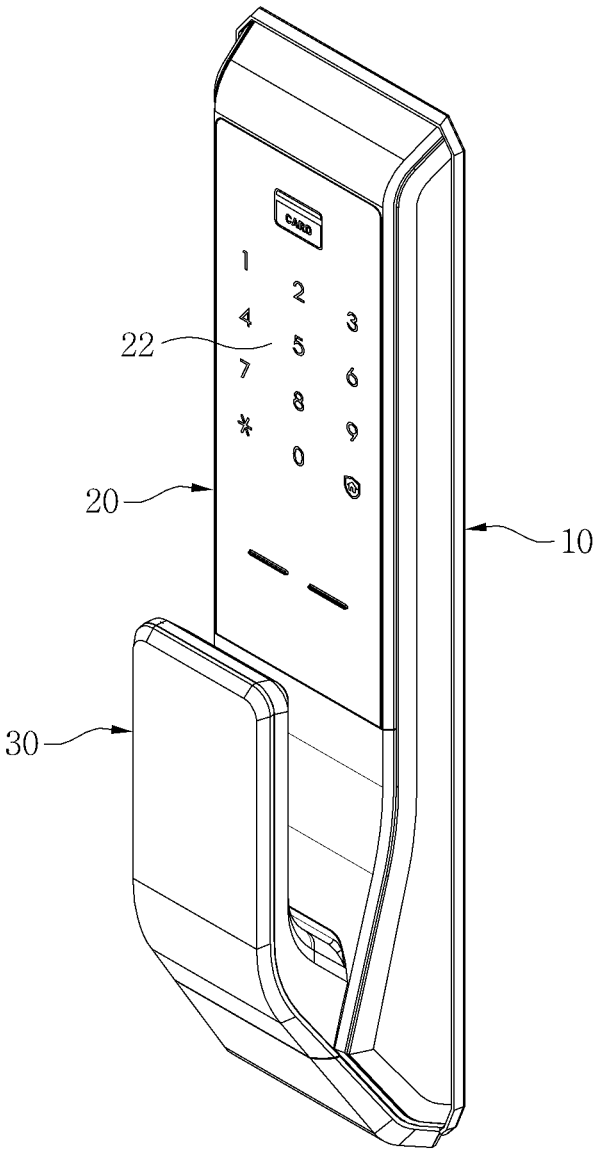
FIGS. 8 and 9 is a perspective view illustrating a state where a key input unit is provided on the housing in the push-pull door lock of FIG. 2.
Figure 9:
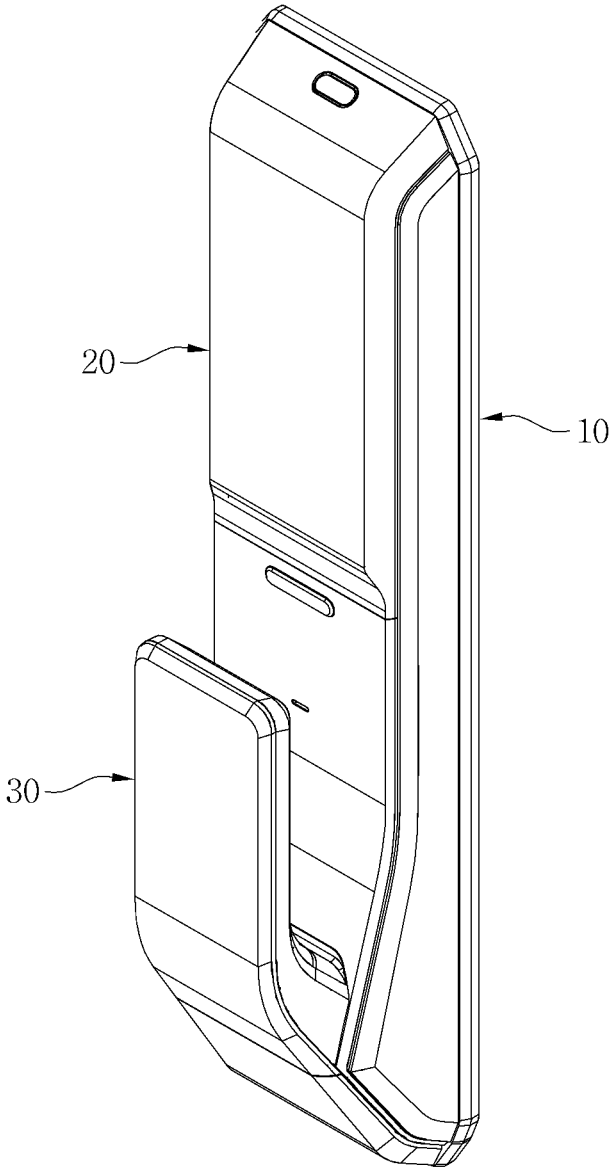

A key input unit 22 may be provided on each of the housings 20 as shown in FIGS. 8 and 9.

Since the key input unit 22 is provided on the housing 20, a dead bolt 130 provided in the lock mechanism 100 may be unlocked when there is a signal input to the key input unit 22.

The feature that the dead bolt 130 of the lock mechanism 100 is opened when there is a signal input to the key input unit 22 is well known in a door lock, and thus a detailed explanation thereof will not be given.

The key input unit 22 may selectively use any one of a keypad (not shown), a keyhole (not shown), and a card reader (not shown), may selectively use a keypad and a keyhole, a keypad and a card reader, or a keyhole and a card reader, or may use all of a keypad, a keyhole, and a card reader.

When the key input unit 22 uses a keypad and a card reader, the dead bolt 130 may be opened by inputting a password through the keypad and contacting a card key.

Each of the levers 30 is coupled to a front surface of the housing 20 to pivot in a front-and-back direction.

A protruding portion 31 may be formed on the lever 30 to protrude toward the door 200.

Since the protruding portion 31 is formed on the lever 30 to protrude toward the door 200 and thus the protruding portion 31 pivots in the front-and-back direction as the lever 30 pivots in the front-and-back direction, a movable member 41 of the driving unit 40 which will be described below may be moved.

Figure 4:
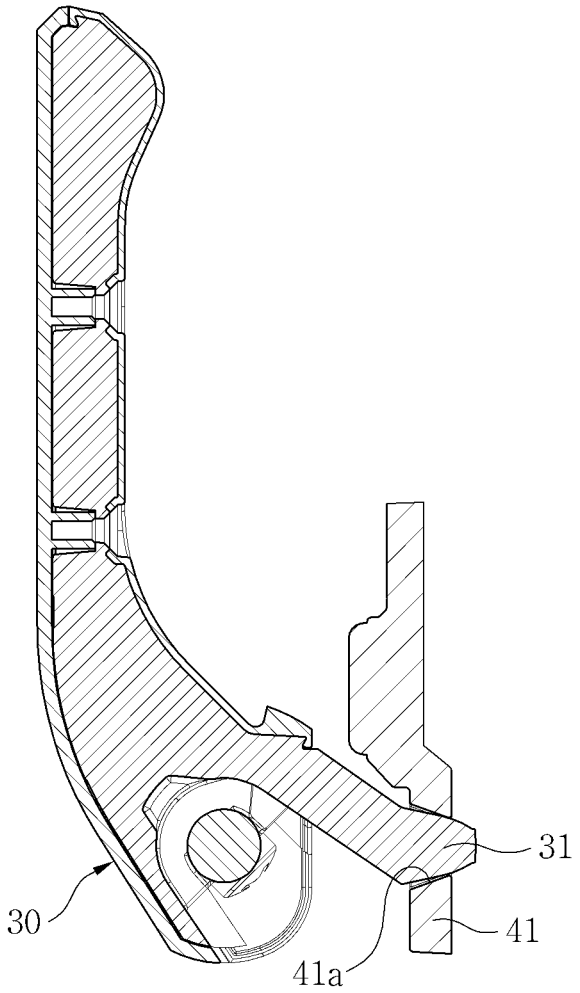
FIG. 4 is a partial cross-sectional view illustrating a state where a movable member of the driving unit and a protruding portion of a lever are coupled to each other in the push-pull door lock of FIG. 2.

The protruding portion 31 of the lever 30 passes through an insertion groove 41*a* formed in the movable member 41 of the driving unit 40 as shown in FIG. 4.

Since the protruding portion 31 of the lever 30 passes through the insertion groove 41*a* formed in the movable member 41 of the driving unit 40, the movable member 41 may be moved upward or downward according to a direction in which the protruding portion 31 inserted into the insertion groove 41*a* pivots.

The selection member 60 which is located behind the protruding portion 31 of the lever 30, that is, on a rear surface of the housing 20 limits a pivoting range of the protruding portion 31 that pivots as the lever 30 pivots.

The selection member 60 may include a first selection hole 61 and a second selection hole 62 having different heights as shown in FIGS. 10 through 13, or only one selection hole 63 as shown in FIGS. 14 through 17.

When the selection member 60 includes the first selection hole 61 and the second selection hole 62, the protruding portion 31 of the lever 30 may be inserted into and caught by the first selection hole 61 or the second selection hole 62 of the selection member 60, thereby limiting a pivoting range of the protruding portion 31.

Figure 10:
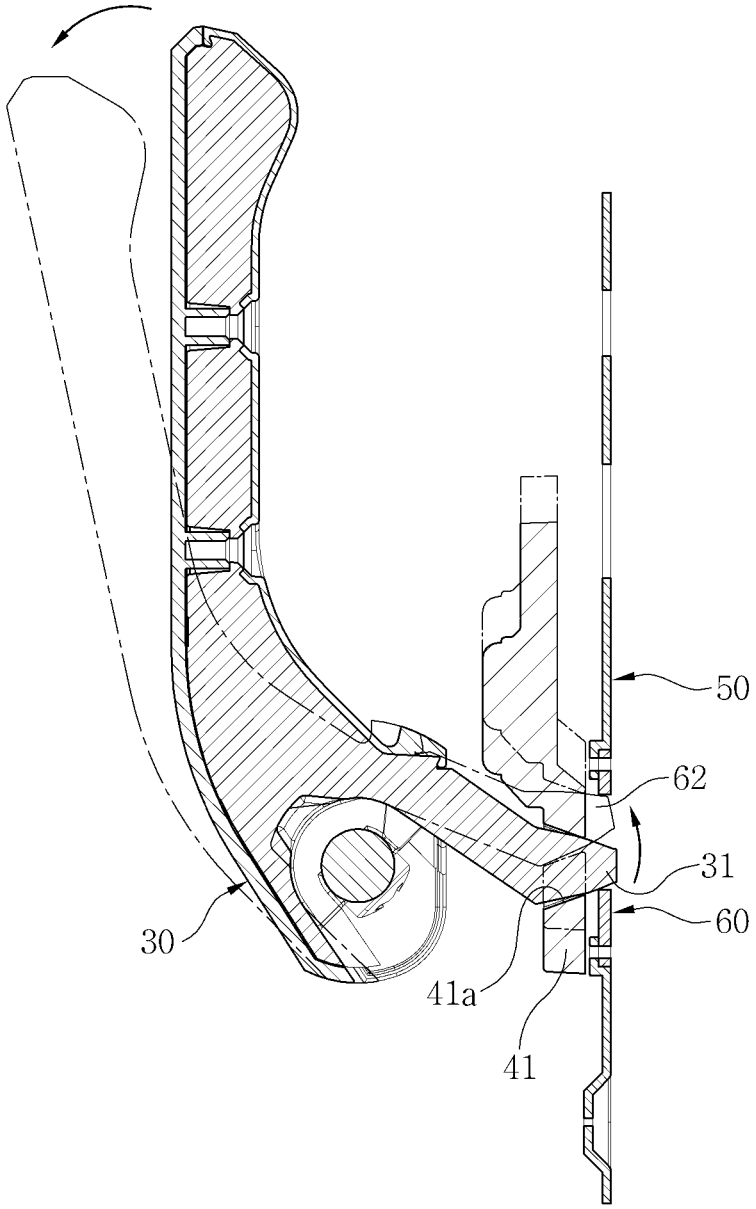
FIGS. 10 and 11 are views illustrating a process of preventing a push operation of the lever using a support plate in the push-pull door lock of FIG. 2, according to an embodiment of the inventive concept.
Figure 11:
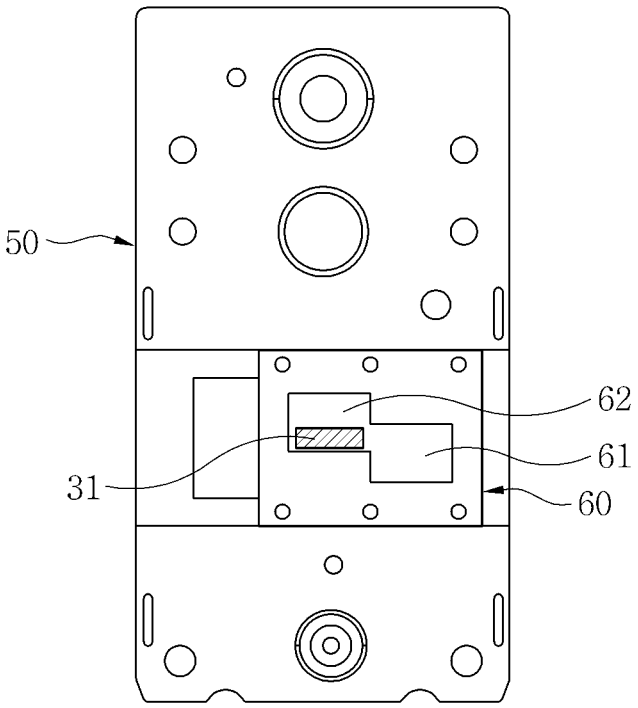
Figure 12:
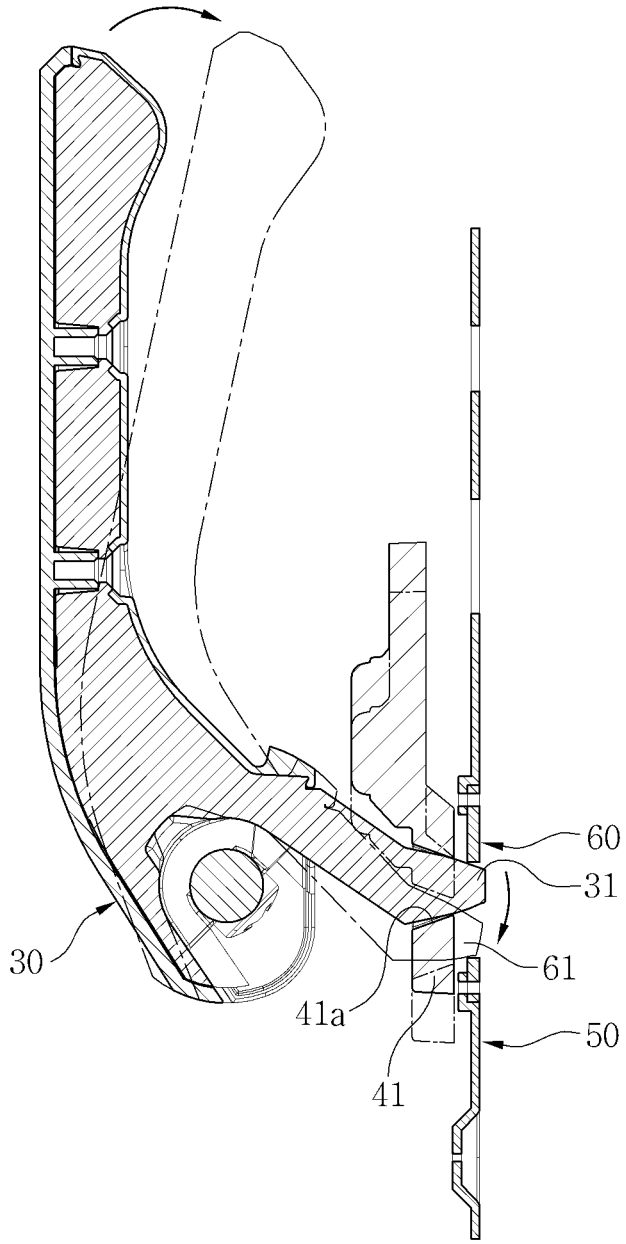
FIGS. 12 and 13 are views illustrating a process of preventing a pull operation of the lever using the support plate in the push-pull door lock of FIG. 2, according to an embodiment of the inventive concept.
Figure 13:
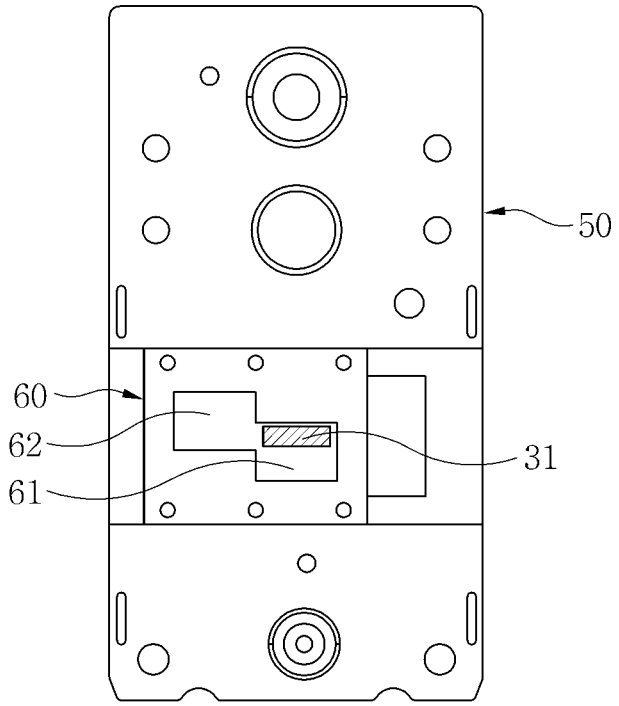

That is, when the protruding portion 31 of the lever 30 is inserted into the first selection hole 61 of the selection member 60 as shown in FIGS. 12 and 13, a top surface of the protruding portion 31 is caught by an upper end of the first selection hole 61 to stop an upward pivoting motion of the protruding portion 31, and when the protruding portion 31 of the lever 30 is inserted into the second selection hole 62 of the selection member 60 as shown in FIGS. 10 and 11, a bottom surface of the protruding portion 31 is caught by a lower end of the second selection hole 62 to stop a downward pivoting motion of the protruding portion 31, thereby limiting a pivoting range of the protruding portion 31 using the selection member 60. Accordingly, pivoting motions of the lever 30 including the protruding portion 31 may also be limited.

In this case, the first selection hole 61 and the second selection hole 62 of the selection member 60 are at different heights and are horizontally connected to each other.

Since the first selection hole 61 and the second selection hole 62 of the selection member 60 are at different heights and are horizontally connected to each other, the protruding portion 31 of the lever 30 may move between the first selection hole 61 and the second selection hole 62.

Meanwhile, the selection member 60 may horizontally move on a support plate 50 for supporting the driving unit 40 that is moved by the protruding portion 31 that pivots along with the lever 30.

Since the selection member 60 may horizontally move on the support plate 50 for supporting the driving unit 40 that is moved by the protruding portion 31 that pivots along with the lever 30, the protruding portion 31 of the lever 30 may be inserted into and caught by the first selection hole 61 or the second selection hole 62 as the selection member 60 horizontally moves.

The driving unit 40 may unlock the lock mechanism 100 by being moved by the protruding portion 31 that pivots along with the lever 30 to rotate an actuating rod 44 connected to the lock mechanism 100 received in the door 200.

When the selection member 60 includes one selection hole 63 as shown in FIGS. 14 through 17, the selection hole 63 is not formed in a central portion of the selection member 60 but is eccentrically formed in an upper portion or a lower portion of the selection member 60. Accordingly, when the selection member 60 is provided on the support plate 50 and a position of the selection member 60 is changed, the selection hole 60 may be located at the upper portion or the lower portion.

Figure 14:
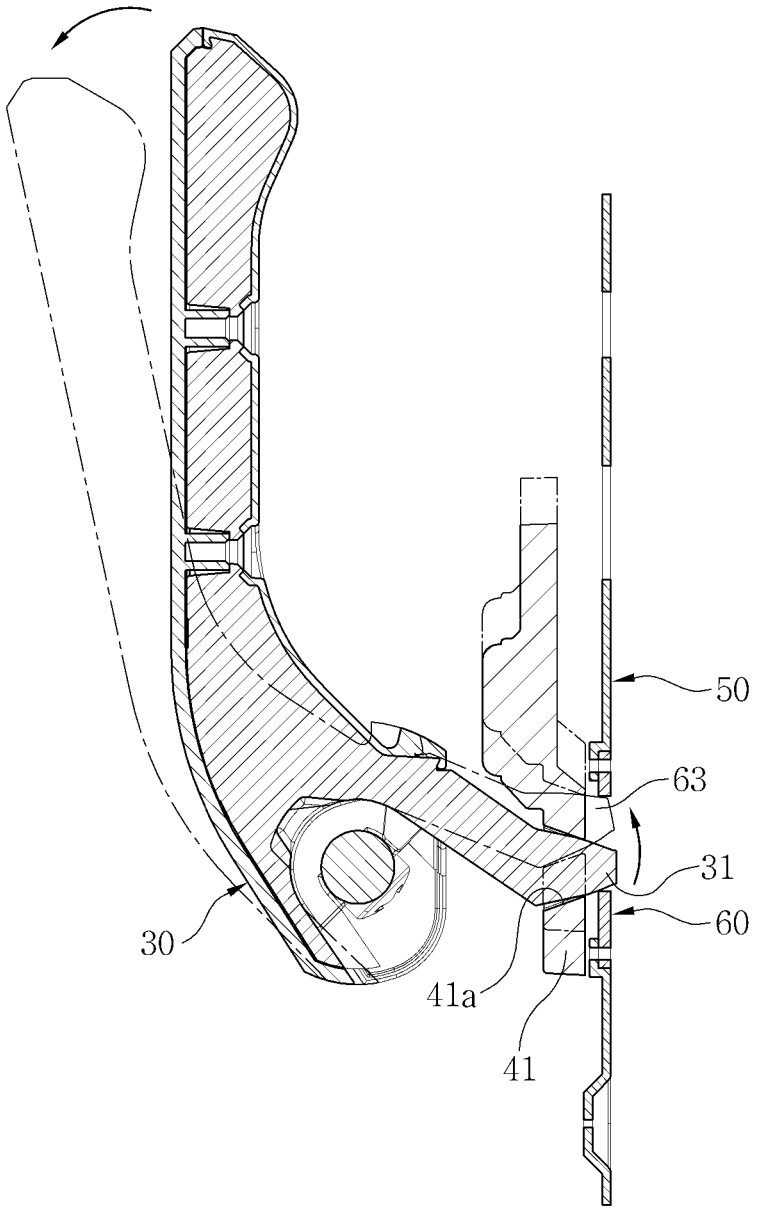
FIGS. 14 and 15 are views illustrating a process of preventing a push operation of the lever using the support plate in the push-pull door lock of FIG. 2, according to another embodiment of the inventive concept.
Figure 15:
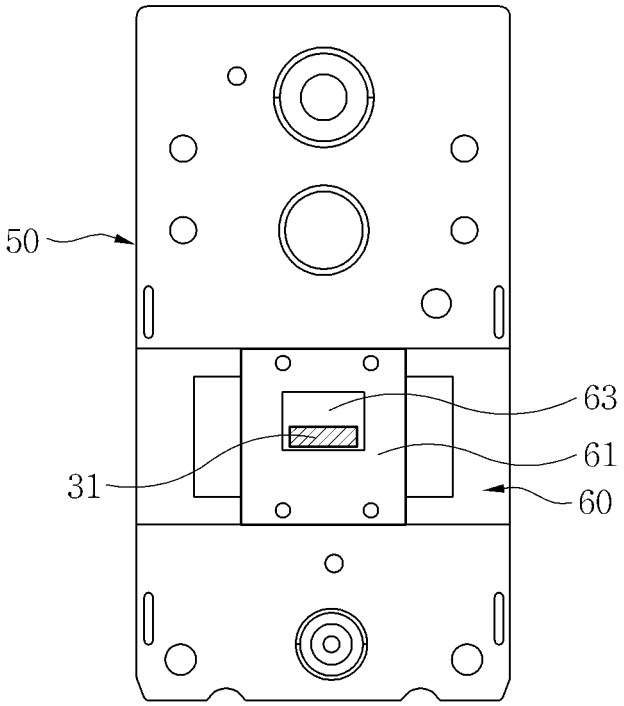
Figure 16:
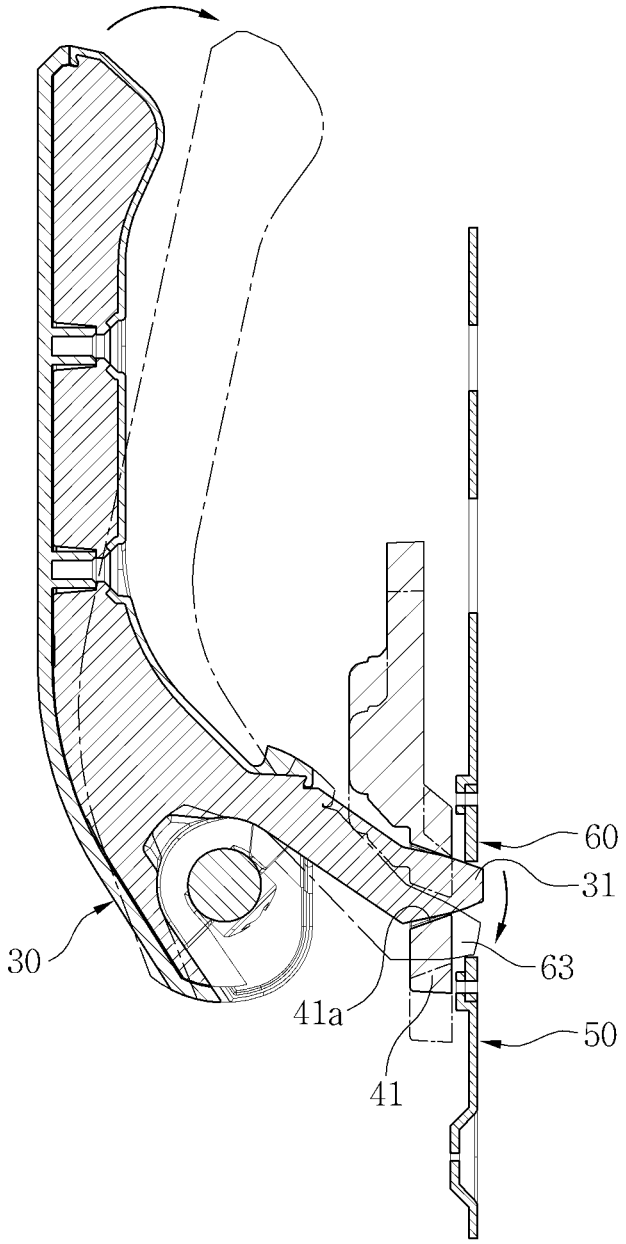
FIGS. 16 and 17 are views illustrating a process of preventing a pull operation of the lever using the support plate in the push-pull door lock of FIG. 2, according to another embodiment of the inventive concept.
Figure 17:
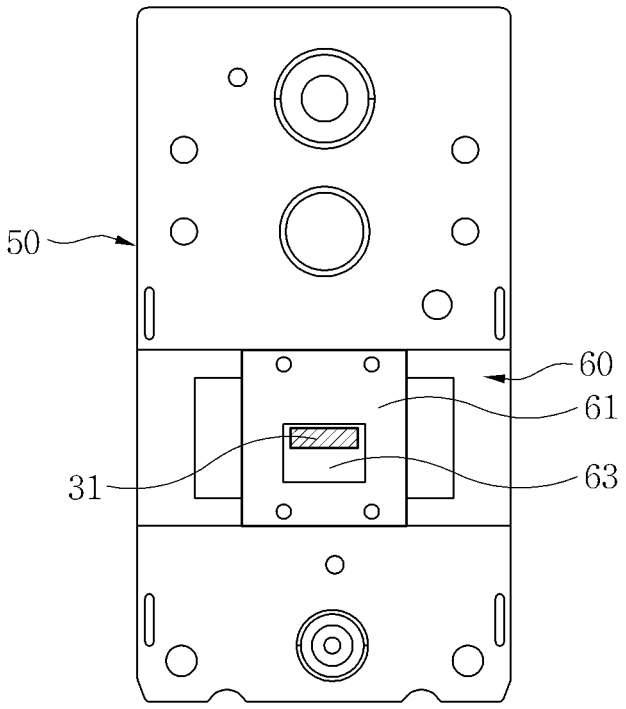

Accordingly, when the protruding portion 31 of the lever 30 is inserted into the selection hole 63 of the selection member 60 as shown in FIGS. 16 and 17, a top surface of the protruding portion 31 is caught by an upper end of the selection hole 63 to stop an upward pivoting motion of the protruding portion 31. Assuming that a position of the selection hole 63 is changed because a position of the selection member 60 is changed, when the protruding portion 31 of the lever 30 is inserted into the selection hole 63 of the selection member 60 as shown in FIGS. 14 and 15, a bottom surface of the protruding portion 31 is caught by a lower end of the selection hole 63 to stop a downward pivoting motion of the protruding portion 31, thereby limiting a pivoting range of the protruding portion 31 using the selection member 60. Accordingly, pivoting motions of the lever 30 including the protruding portion 31 may also be limited.

Figure 3:
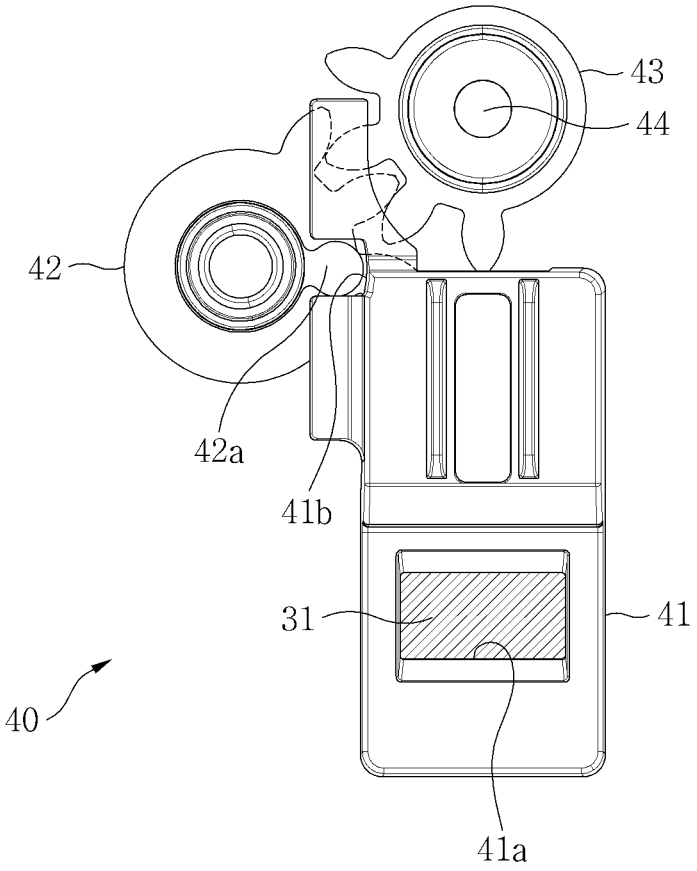
FIG. 3 is a front view illustrating a driving unit of the push-pull door lock of FIG. 2.

Referring to FIG. 3, the driving unit 40 may include the movable member 41, a first gear 42, and a second gear 43.

The insertion groove 41*a* that extends in the front-and-back direction is formed in the movable member 41 and a projecting jaw 41*b* is formed on a side surface of the movable member 41. A protrusion 42*a* inserted into the projecting jaw 4 lb of the movable member 41 is formed on the first gear 42. The second gear 43 meshes with the first gear 42, and the actuating rod 44 connected to the lock mechanism 100 of the door 200 is coupled to a central portion of the second gear 43.

Accordingly, when the protruding portion 31 of the lever 30 pivots while being inserted into the insertion groove 41*a* and thus the movable member 41 is moved upward or downward, since the projecting jaw 41*b* of the movable member 41 rotates the first gear 42 and the first gear 42 rotates the second gear 43, the actuating rod 44 coupled to the central portion of the second gear 43 rotates as a result, thereby opening the lock mechanism 100 of the door 200.

In this case, the actuating rod 44 coupled to the second gear 43 of the driving unit 40 which is rotating moves a latch bolt 140 provided in the lock mechanism 100.

The latch bolt 140 provided in the lock mechanism 100 may move according to the rotation of the actuating rod 44 by using any of common structures and methods, and thus a detailed explanation thereof will not be given.

The protrusion 42*a* formed on the first gear 42 may protrude forward from a front surface of the first gear 42.

Since the protrusion 42*a* formed on the first gear protrudes forward from the front surface of the first gear 42, the protrusion 42*a* may be inserted into the projecting jaw 41*b* of the movable member 41 even when the first gear 42 and the second gear 43 mesh with each other.

The driving unit 40 is disposed on the support plate 50.

In this case, the support plate 50 slidably supports the movable member 41, and pivotably supports the first gear 42 and the second gear 43.

The support plate 50 and the selection member 60 may be simply coupled using bolts, and thus a detailed explanation thereof will not be given.

A process of selecting a lever work direction in the push-pull door lock A will now be explained in detail.

Figure 5:
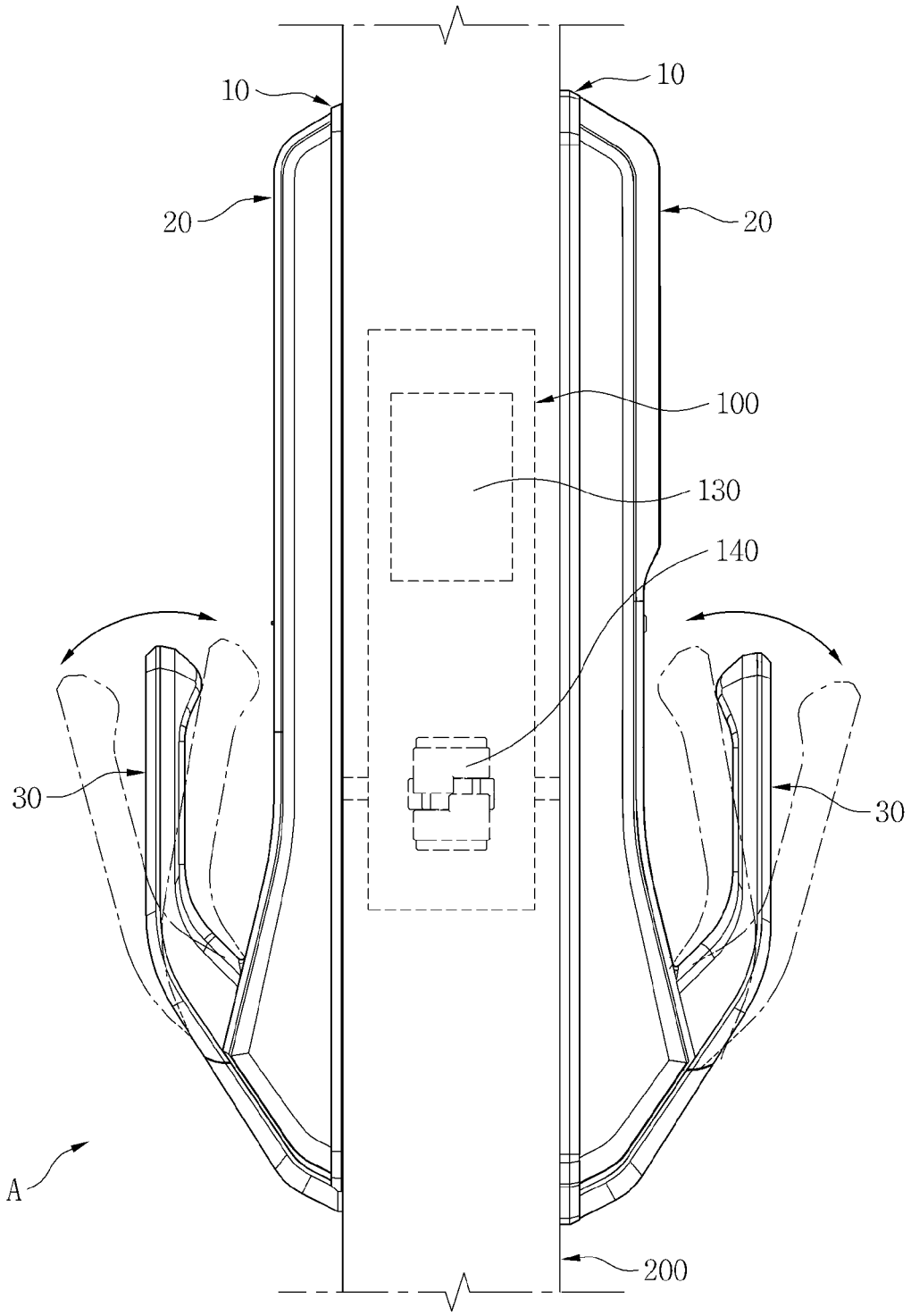
FIG. 5 is a cross-sectional view illustrating a state where the push-pull door lock of FIG. 2 is used.

Referring to FIG. 5, the levers 30 are provided on the housings 20 coupled to a front surface and a rear surface of the door 200.

In this case, the protruding portion 31 is formed on the lever 30 to protrude toward the door 200, and the lever 30 pivotably moves in the front-and-back direction on the housing 20.

The driving unit 40 is disposed between the housing 20 and the support 10 coupled to each of the front surface and the rear surface of the door 200.

In this case, the driving unit 40 includes: the movable member 41 having a front surface that extends in the front-and-back direction and in which the insertion groove 41*a* is formed and having one side surface on which the projecting jaw 41*b* is formed; the first gear 42 including the protrusion 42*a* inserted into the projecting jaw 41*b* of the movable member 41; and the second gear 43 meshing with the first gear 42 and having a central portion to which the actuating rod 44 connected to the lock mechanism 100 of the door 200 is coupled.

A front end of the protruding portion 31 of the lever 30 is inserted into the insertion groove 41*a* formed in the movable member 41 of the driving unit 40 which is adjacent to the protruding portion 31 of the lever 30.

Figure 7:
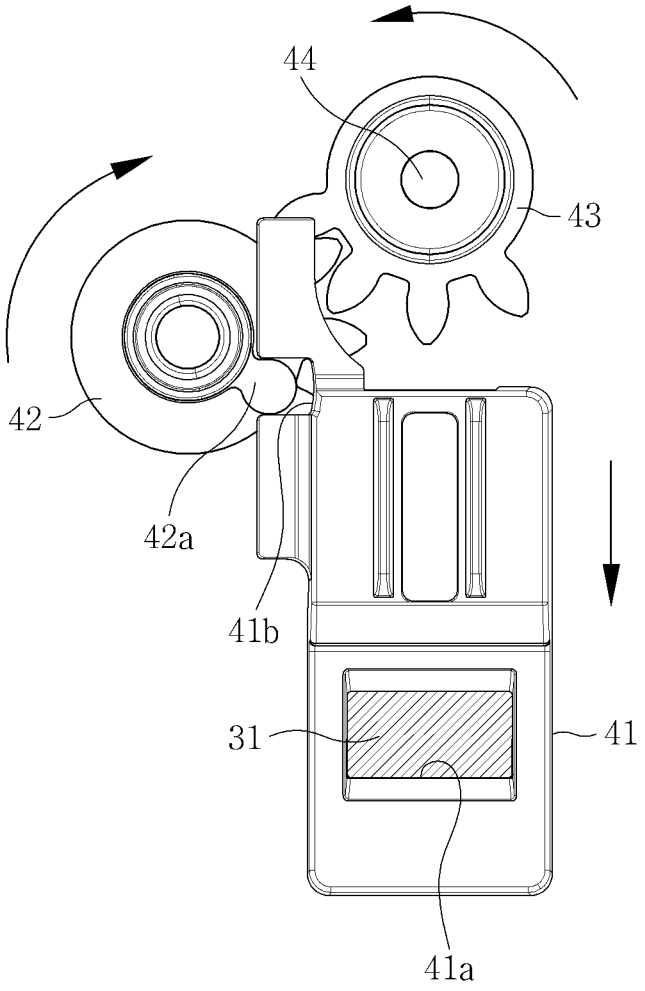
FIG. 7 is a front view illustrating an operation of the driving unit in a lever push state of the push-pull door lock of FIG. 2.

Accordingly, when the lever 30 on the housing 20 is pushed to pivot forward as shown in FIG. 7, the protruding portion 31 inserted into the insertion groove 41*a* of the movable member 41 is lowered to lower the movable member 41. Since the movable member 41 which is lowered includes the projecting jaw 41*b* into which the protrusion 42*a* of the first gear 42 is inserted, the first gear 42 is forced to rotate. Since the first gear 42 which rotates messes with the second gear 43, the second gear 43 is forced to rotate, to rotate the actuating rod 44 along with the second gear 43, thereby unlocking the lock mechanism 100.

Figure 6:
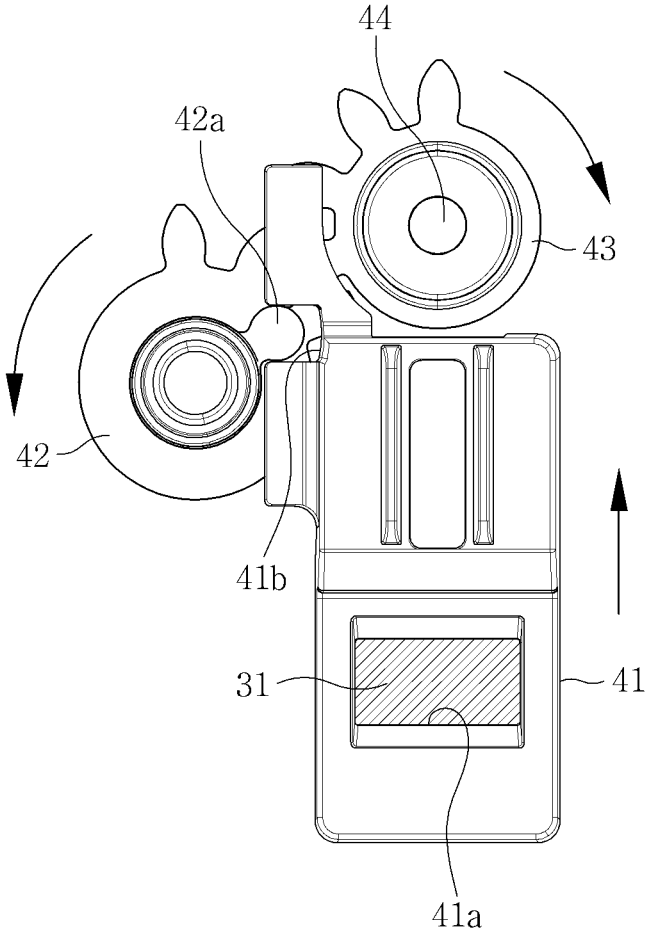
FIG. 6 is a front view illustrating an operation of the driving unit in a lever pull state of the push-pull door lock of FIG. 2.

When the lever 30 on the housing 20 is pulled to pivot backward as shown in FIG. 6, the protruding portion 31 inserted into the insertion groove 41*a* of the movable member 41 is raised to raise the movable member 41. Since the movable member 41 which is raised includes the projecting jaw 41*b* into which the protrusion 42*a* of the first gear 42 is inserted, the first gear 42 is forced to rotate. Since the first gear 42 which rotates meshes with the second gear 43, the second gear 43 is forced to rotate, to rotate the actuating rod 44 along with the second gear 43, thereby unlocking the lock mechanism 100.

As such, since when the lever 30 pivots in the front-and-back direction, the driving unit 40 operates to rotate the actuating rod 44 and thus the lock mechanism 100 is unlocked, the push-pull door lock A may be conveniently installed without needing to coincide a door opening direction with a lever work direction.

In this case, the lock mechanism 100 may be unlocked by pulling the lever 30 at a side where the door 200 is opened by being pushed, and may be unlocked by pushing the lever 30 at a side where the door 200 is opened by being pulled.

However, when the lever 30 is pulled at a side where the door 200 is opened by being pushed, an operation of pushing the door 200 and an operation of pulling the lever 30 may not coincide with each other, thereby leading to an awkward position, and when the lever 30 is pushed at a side where the door 200 is opened by being pulled, an operation of pulling the door 200 and an operation of pushing the lever 30 may not coincide, thereby leading to an awkward position. Accordingly, it is preferable that a lever work direction and a door opening direction coincide with each other.

In the present embodiment, the selection member 60 is provided on the support plate 50 behind the protruding portion 31 of the lever 30.

In this case, the selection member 60 includes the first selection hole 61 and the second selection hole 62.

Accordingly, when the selection member 60 on the support plate 50 is moved to one side at a side where the door 200 is opened by being pushed and thus the protruding portion 31 of the lever 30 is inserted into the first selection hole 61 of the selection member 60 as shown in FIGS. 12 and 13, since a top surface of the protruding portion 31 is caught by an upper end of the first selection hole 61 to stop an upward pivoting motion of the protruding portion 31, the door 200 may be opened only due to a forward pivoting motion, that is, a push operation, of the lever 30.

By contrast, when the selection member 60 on the support plate 50 is moved to another side at a side where the door 200 is opened by being pulled and thus the protruding portion 31 of the lever 30 is inserted into the second selection hole 62 as shown in FIGS. 10 and 11, since a bottom surface of the protruding portion 31 is caught by a lower end of the second selection hole 62 to stop a downward pivoting motion of the protruding portion 31, the door 200 may be opened only due to a backward pivoting motion, that is, a pull operation, of the lever 30.

The latch bolt 140 of the lock mechanism 100 is unlocked by the lever 30. If the dead bolt 130 of the lock mechanism 100 is locked, the door 200 may not be opened.

However, since the key input unit 22 is provided on the housing 20 in the present embodiment, the dead bolt 130 provided in the lock mechanism 100 may be unlocked when there is a signal input through the key input unit 22, thereby smoothly opening the door 200.

In this case, the key input unit 22 is provided on the housing 20 located in an exterior.

Since the key input unit 22 is provided on the housing 20 located in the exterior, the door 200 may be opened by inputting a key carried by a user in the exterior into the key input unit 22.

As can be seen from the foregoing, the push-pull door lock A according to the inventive concept unlocks the lock mechanism 100 by moving the driving unit 40 disposed between the support 10 and the housing 20 using the protruding portion 31 of the lever 30 that pivots in the front-and-back direction to rotate the actuating rod 44 connected to the lock mechanism 100 received in the door 200. Since the door 200 may be opened in both a push operation and a pull operation of the lever 30, the push-pull door lock A may be conveniently installed without needing to coincide a door opening direction with a lever work direction. Since the support plate 50 for limiting a pivoting range of the protruding portion 31 that pivots as the lever 30 pivots is provided behind the driving unit 40, when the lever 30 operates in any one of a push direction and a pull direction which coincides with the door opening direction by limiting a pivoting range of the protruding portion 31 using the support plate 50, the door opening direction of the door 200 and the lever work direction of the lever 30 may coincide with each other and the door 200 may be conveniently opened in a natural position.

The foregoing is illustrative of embodiments and is not to be construed as limiting thereof Although a few embodiments have been described, those skilled in the art will readily appreciate that many modifications are possible in embodiments without materially departing from the novel teachings and advantages. Accordingly, all such modifications are intended to be included within the scope of this inventive concept as defined in the claims. In the claims, means-plus-function clauses are intended to cover the structures described herein as performing the recited function, and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A push-pull door lock capable of selecting a lever work direction, the push-pull door lock comprising:

a housing disposed on one side or the other side of a door;

a lever pivotally supported on the housing to be pushed toward or pulled from the door, the lever including a protruding portion integrally formed with the lever and protruding toward inside the housing, the protruding portion moving in a first direction substantially perpendicular to pushing direction of the lever when the lever is pushed and in a second direction opposite to the first direction when the lever is pulled; and a driving unit disposed inside the housing and operatively connected to the protruding portion;

a lock mechanism installed in the door and operatively connected to the driving unit, the lock mechanism being unlocked when the lever is both pushed and pulled;

a selection member disposed inside the housing and operatively connected to the protruding portion, the selection member having a first selection position and a second selection position, wherein one of the first selection position and the second selection position can be selected when the housing is installed in the door so that the lever can be only pushed or pulled, and wherein the selection member includes a hole into which the protruding portion is inserted, the hole having a first edge to prevent the protruding portion from moving in the second direction at the first selection position and a second edge to prevent the protruding portion from moving in the first direction at the second selection position.

2. The push-pull door lock of claim 1, wherein the hole includes a first selection hole having the first edge and a second selection hole having the second edge.

3. The push-pull door lock of claim 2, wherein the first selection hole and the second selection hole are open to each other.

4. The push-pull door lock of claim 1, further comprising a support plate disposed inside the housing, wherein the selection member is fixedly disposed on one side of the support plate at the first selection position or at the second selection position.

5. The push-pull door lock of claim 4, wherein the driving unit includes a movable member having an insertion groove into which the protruding portion is inserted, the movable member slides on the other side of the support plate.

6. The push-pull door lock of claim 1, wherein a key input unit is provided on the housing that is located in an exterior.

7. The push-pull door lock of claim 6, wherein the key input unit comprises any one or more of a keypad, a keyhole, and a card reader.

* * * * *